US009985360B2

(12) United States Patent
Heistand, II et al.

(10) Patent No.: US 9,985,360 B2
(45) Date of Patent: May 29, 2018

(54) ELECTRICAL CONNECTOR FOR AN INFORMATION HANDLING SYSTEM

(71) Applicant: DELL PRODUCTS, LP, Round Rock, TX (US)

(72) Inventors: Raymond D. Heistand, II, Round Rock, TX (US); Sandor Farkas, Round Rock, TX (US); Bhyrav Mutnury, Round Rock, TX (US)

(73) Assignee: DELL PRODUCTS, LP, Round Rock, TX (US)

( * ) Notice: Subject to any disclaimer, the term of this patent is extended or adjusted under 35 U.S.C. 154(b) by 0 days. days.

(21) Appl. No.: 15/443,384

(22) Filed: Feb. 27, 2017

(65) Prior Publication Data

US 2017/0170578 A1 Jun. 15, 2017

Related U.S. Application Data

(63) Continuation of application No. 14/924,519, filed on Oct. 27, 2015, now Pat. No. 9,583,845.

(51) Int. Cl.

| | |
|---|---|
| ***H01R 13/62*** | (2006.01) |
| ***H01R 4/28*** | (2006.01) |
| ***H01R 24/60*** | (2011.01) |
| ***H01R 13/193*** | (2006.01) |
| *H01R 107/00* | (2006.01) |

(52) U.S. Cl.

CPC ..... *H01R 4/28* (2013.01); *H01R 13/193* (2013.01); *H01R 24/60* (2013.01); *H01R 2107/00* (2013.01)

(58) Field of Classification Search

CPC H01R 13/193; H01R 23/684; H01R 23/6833; H01R 23/6846; H01R 23/7068; H05K 7/1023

USPC ..... 439/259, 260, 263, 266, 267, 635, 637

See application file for complete search history.

(56) References Cited

U.S. PATENT DOCUMENTS

| | | | | |
|---|---|---|---|---|
| 3,982,807 | A | 9/1976 | Anhalt et al. | |
| 4,232,926 | A | 11/1980 | Inouye et al. | |
| 4,904,197 | A | 2/1990 | Cabourne | |
| 5,044,980 | A | 9/1991 | Krumme et al. | |
| 5,049,087 | A | 9/1991 | Chung et al. | |
| 5,160,275 | A | 11/1992 | Nakamura et al. | |
| 5,679,018 | A * | 10/1997 | Lopata | H01R 12/716 439/260 |
| 5,795,171 | A | 8/1998 | Bernardini | |
| 6,042,410 | A | 3/2000 | Watanabe | |
| 6,083,023 | A | 7/2000 | Kamath | |
| 6,238,226 | B1 * | 5/2001 | Schempp | H01R 12/87 439/260 |
| 6,406,332 | B1 | 6/2002 | Buican et al. | |
| 6,422,887 | B1 | 7/2002 | Myer et al. | |

(Continued)

*Primary Examiner* — Thanh Tam Le
(74) *Attorney, Agent, or Firm* — Larson Newman, LLP

(57) ABSTRACT

An electrical connector may be used to connect and propagate signals between electrical systems, devices, and components. The electrical connector may comprise a male conductor component with one or more contacts positioned on a member. The electrical connector may comprise a female conductor component configured to be a receptacle for receiving a portion of the male conductor and having one or more moveable conduction arms which may be actuated to contact respective one or more contacts positioned on the member of the male conductor component.

17 Claims, 8 Drawing Sheets

(56) References Cited

U.S. PATENT DOCUMENTS

| | | | | |
|---|---|---|---|---|
| 6,572,396 | B1 * | 6/2003 | Rathburn | H01R 12/89 439/260 |
| 6,665,149 | B2 | 12/2003 | Abe | |
| 6,918,778 | B2 | 7/2005 | Ruckerbauer et al. | |
| 6,979,216 | B2 * | 12/2005 | Maeda | H01R 12/88 439/260 |
| 7,014,487 | B2 * | 3/2006 | Ishikawa | H01R 13/055 439/267 |
| 7,390,208 | B1 | 6/2008 | Sabo | |
| 7,438,578 | B1 | 10/2008 | Nin et al. | |
| 7,922,495 | B2 | 4/2011 | Masuda | |
| 7,976,344 | B2 | 7/2011 | Brunker et al. | |
| 8,616,907 | B2 | 12/2013 | Kim et al. | |
| 8,888,508 | B2 | 11/2014 | Chen | |
| 8,905,773 | B2 | 12/2014 | Liang | |
| 9,407,035 | B2 * | 8/2016 | Arimai | H01R 43/24 |
| 2008/0085633 | A1 | 4/2008 | Dawiedczyk et al. | |
| 2011/0207357 | A1 | 8/2011 | Dick et al. | |

* cited by examiner

ELECTRICAL CONNECTOR FOR AN INFORMATION HANDLING SYSTEM

CROSS-REFERENCE TO RELATED APPLICATIONS

This application is a continuation of U.S. patent application Ser. No. 14/924,519, entitled "Electrical Connector for an Information Handling System," filed on Oct. 27, 2015, the disclosure of which is hereby expressly incorporated by reference in its entirety.

Related subject matter is contained in co-pending PCT Application No. PCT/US15/068286 filed on Oct. 27, 2015, the disclosure of which is hereby incorporated by reference.

FIELD OF THE DISCLOSURE

The present disclosure generally relates to information handling systems, and more particularly relates to an electrical connector for an information handling system.

BACKGROUND

As the value and use of information continues to increase, individuals and businesses seek additional ways to process and store information. One option is an information handling system. An information handling system generally processes, compiles, stores, or communicates information or data for business, personal, or other purposes. Technology and information handling needs and requirements can vary between different applications. Thus information handling systems can also vary regarding what information is handled, how the information is handled, how much information is processed, stored, or communicated, and how quickly and efficiently the information can be processed, stored, or communicated. The variations in information handling systems allow information handling systems to be general or configured for a specific user or specific use such as financial transaction processing, airline reservations, enterprise data storage, or global communications. In addition, information handling systems can include a variety of hardware and software resources that can be configured to process, store, and communicate information and can include one or more computer systems, graphics interface systems, data storage systems, networking systems, and mobile communication systems.

Information handling systems may have components formed on printed circuit boards (PCBs). The PCBs in turn may be connected together.

BRIEF DESCRIPTION OF THE DRAWINGS

It will be appreciated that for simplicity and clarity of illustration, elements illustrated in the Figures are not necessarily drawn to scale. For example, the dimensions of some elements may be exaggerated relative to other elements. Embodiments incorporating teachings of the present disclosure are shown and described with respect to the drawings herein, in which.

The use of the same reference symbols in different drawings indicates similar or identical items.

DETAILED DESCRIPTION OF THE DRAWINGS

The following description in combination with the Figures is provided to assist in understanding the teachings disclosed herein. The description is focused on specific implementations and embodiments of the teachings, and is provided to assist in describing the teachings. This focus should not be interpreted as a limitation on the scope or applicability of the teachings.

Figure 1A:
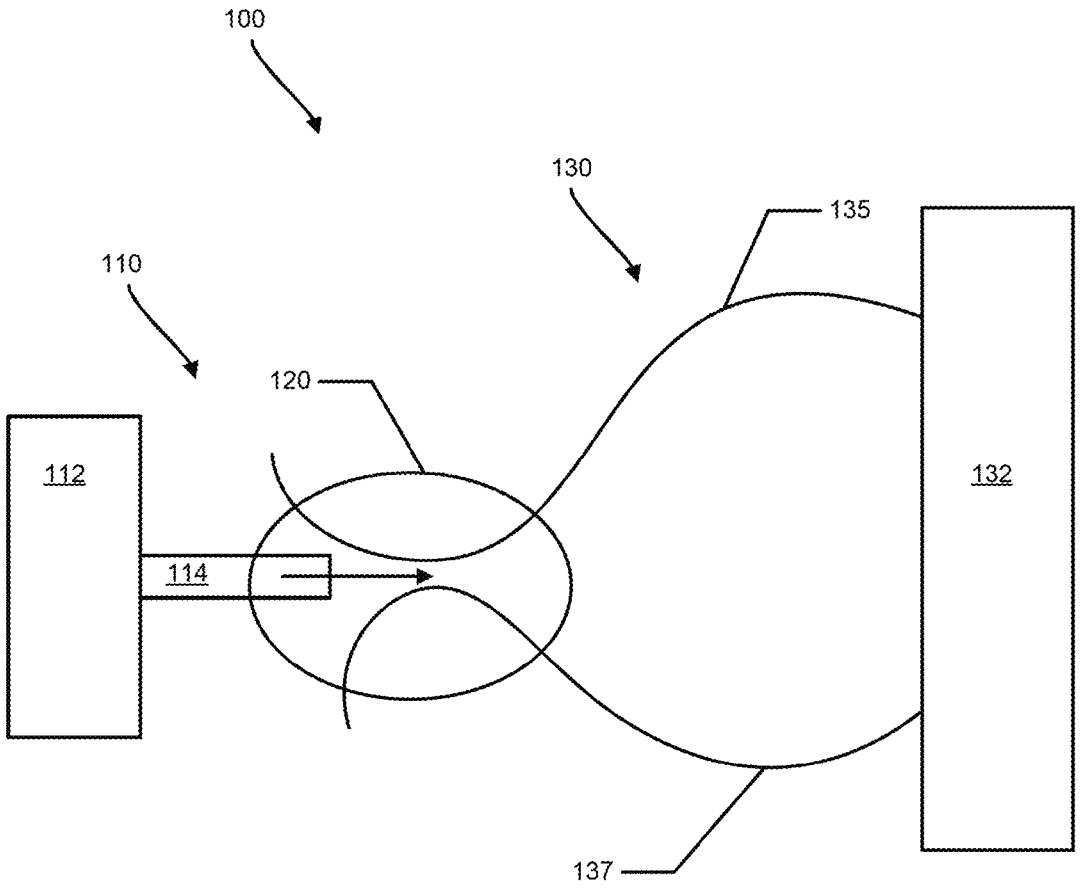
FIGS. 1*a* and 1*b* are schematic views of an embodiment of a connector.

FIG. 1*a* illustrates a common connector 100. Such a connector may be used to electrically couple PCBs and components on different PCBs. Electronic devices and systems may include electrical systems and components formed on PCBs, and these PCBs may be connected together to form the electrical devices and systems. Thus, some form of connectors are required to electrically connect the PCBs together. For example, the connectors connecting the PCBs together may be required to provide electrical connections between PCBs, and provide electrical net and ground plane connections across multiple PCBs.

For example, connector 100 may be used to electrically couple two different PCB boards and respective components on the two different PCB boards. In another example, connector 100 may be used to couple two PCBs together to provide a common ground plane for the PCBs. Connector 100 may include two components: a male conductor component 110 and a female conductor component 130. Male conductor component 110 includes electrical connector element 112 and conducting member 114. Conducting member 114 may be electrically conductive. Electrical conductor element 112 may be electrically connected to a PCB component or net. Electrical conductor element 112 may be electrically connected to conducting member 114 such that an electrical connection to conducting member 114 results in an electrical connection to the PCB component or net electrical coupled to electrical conductor element 112.

Female conductor component 130 acts as a receptacle for conducting member 114. Female conductor component 130 comprises electrical connector element 132 and receptacle elements 135 and 137. One or both of receptacle elements 135 and 137 may be electrically conductive. Electrical conductor element 132 may be electrically connected to a PCB component or net. Electrical conductor element 132 may be electrically connected to receptacle elements 135 and 137 such that an electrical connection to at least one of receptacle elements 135 and 137 results in an electrical connection to the PCB component or net electrical coupled to electrical conductor element 132. As shown in FIG. 1*a*, receptacle elements 135 and 137 may be positioned relative to each other to receive conducting member 114 (as shown by the directional arrow). Receptacle elements 135 and 137 may be configured to be in tension relative to each other and receive conducting member 114 between each other such that at least one of receptacle elements 135 and 137 is physically and electrically connected to conducting member 114. 120 indicates the connection juncture.

Figure 1B:
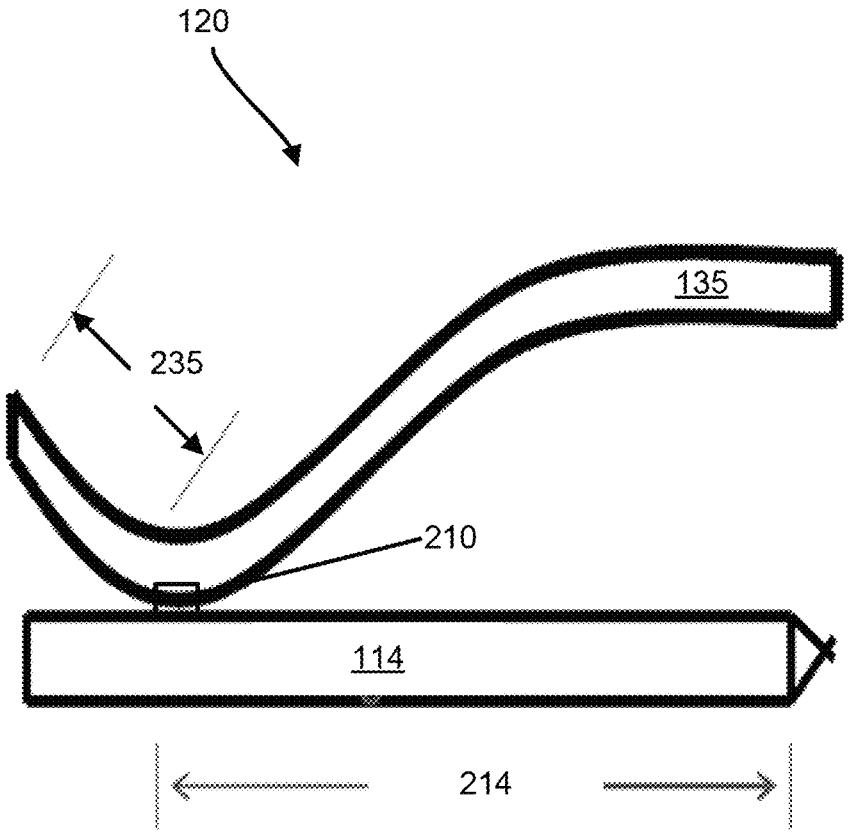

FIG. 1*b* shows connection juncture 120 after connection between conducting member 114 and receptacle elements 135 and 137, and in relatively larger dimensions than FIG. 1*a*. As can be seen from 120, there is a physical and electrical connection between conducting member 114 and receptacle element 135 at 210. Also 120 illustrates tolerances 214 and 235. Tolerance 214 is the length of conducting member 114 not in contact with receptacle element 135 (the length past connection point 210) and may be considered stub 214, and tolerance 235 is the length of receptacle element 135 not in contact with conducting member 114 (the length past point 210) and may be considered stub 235. Generally, a tolerance is a mechanical extension to ensure male and female parts mate reliably. Stubs 214 and 235 have electrical frequency resonances as defined by:

$$F_r=1/(4*L*t_{prop}) \quad (1)$$

Where L is the length of the stub, and tprop is the propagation delay through the stub.

The electrical frequency resonances of stubs 214 and 235 may have a negative effect on electrical connections, because signals propagating in the connector at those frequencies are reflected back opposite the intended direction of propagation and as such distort signals travelling over the connection. Thus, as the frequency of signals propagated between PCBs via conductors such as conductor 100 increases, at one or more frequencies, signals may be reflected in the direction opposite to intended propagation, rendering the electrical connection uncertain at those frequencies. That is, signals at those frequencies may see extreme attenuation when propagated over the connection.

To overcome this problem, it is desired to minimize the length of any stubs in a connection such as stubs 214 and 235, thereby pushing out (that is, increasing the frequencies) the reflected resonant frequencies that will be reflected in the connectors. That is, minimizing the length of the connector stubs, for example, via tighter tolerances, increases the frequency required to generate resonate frequencies off the stub(s).

Figure 2:
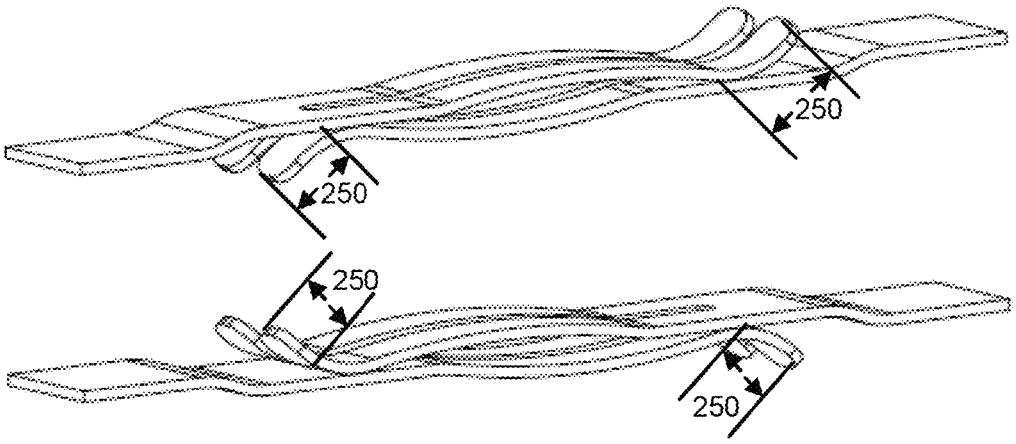
FIG. 2 is an example embodiment of a connector.

FIG. 2 shows another connector 200 designed to minimize stub length, shown in FIG. 2 as 250. As can be seen from FIG. 2, stub length 250 of connector 200 is relatively less than the length of stub 214 of connector 100, and therefore reflects signals of a higher frequency than stub 214. In other words, the signal frequency traversing the connector affected (for example, reflected) by stub length 250 of connector 200 is pushed out to higher frequencies relative to stub 214 of connector 100.

As the operation frequencies of electrical components of PCBs increases (for example higher clock frequencies bundled in signals passed between PCBs), it is desired to minimize stub lengths causing signal reflection and interference in connector connections such as stubs 214, 235, and 250.

FIGS. 3*a*-3*d* show a connector 300 inherently amenable to tolerances leading to minimal stub lengths. Thus, the connector 300 may be operable to propagate signals having frequency components that are higher in frequency over a connection without attenuation due to frequency resonance and reflection. Connector 300 may achieve electrical connection and coupling via a pincing (derivative of pincer) or pinching between conductor elements. FIGS. 3*a*-3*d* capture connector 300 at different stage of operation and connection.

Connector 300 comprises two components: male conductor component 310 and female conductor component 330. Male conductor component 312 comprises electrical connector element 312 and engagement member 316 which is coupled to electrical connector element 310 as shown. Coupled to the base (relative to electrical connector element 312) of engagement member 316 are conduction elements 314*a* and 314*b*. Conduction elements 314*a* and 314*b* are electrically coupled to electrical connector element 312 such that a PCB net or ground coupled to electrical connector element 312 is electrically coupled to conduction elements 314*a* and 314*b* via electrical connector element 312.

Female conductor component 330 is configured as a receptacle to receive engagement member 316, and comprises a mechanical actuator and electrical contacts moveable by the mechanical actuator to contact conduction elements 314*a* and 314*b* of engagement member 316.

Female conductor component 330 comprises electrical connector element 332, conduction arms 334*a* and 334*b*, actuator element 336, and actuator arms 338*a* and 338*b*. As shown, actuator arms 338*a* and 338*b* are coupled to electrical connector element 332 with pivots 337*a* and 337*b*, respectively, at the bases of actuator arms 338*a* and 338*b* so that actuator arms 338*a* and 338*b* may move in an arc. Similarly, in embodiments, conduction arms 334*a* and 334*b* may be coupled to electrical connector element 332 with respective pivots at the bases of conduction arms 334*a* and 334*b*. As shown, in 300, actuator arms 338*a* and 338*b* are positioned to the outside of conduction arms 334*a* and 334*b* to bear on conduction arms 334*a* and 334*b*.

Conduction arms 334*a* and 334*b* correspond to conduction elements 314*a* and 314*b* (of 310), respectively, and are electrically conductive. Conduction arms 334*a* and 334*b* function as electrical contacts. Conduction arms 334*a* and 334*b* are electrically coupled to electrical connector element 332 such that a PCB net or ground coupled to electrical connector element 332 is electrically coupled to conduction arms 334*a* and 334*b* via electrical connector element 332. When actuator element 336 is actuated, for example, depressed, relative to electrical conductor element 332, actuator arms 338*a* and 338*b* are impelled against conduction arms 334*a* and 334*b*, respectively. When used in conjunction with male conductor component 310, connection arms 334*a* and 334*b* contact conduction elements 314*a* and 314*b*, respectively, forming an electrical connection between male conductor component 310 and female conductor component 330.

Electrical connector 332 includes a set of mechanical linkages (not shown) interior to the mechanical body of 332. The set of mechanical linkages mechanically link actuator element 336 to actuator arms 338*a* and 338*b* such that when actuator element 336 is actuated relative to the mechanical body of 332, the set of mechanical linkages move to cause actuator arms 338*a* and 338*b* to move together relative to each other in a pincing movement (shown by the directional arrows of FIG. 3*b*). The set of mechanical linkages can comprise a lever arrangement.

Figure 3A:
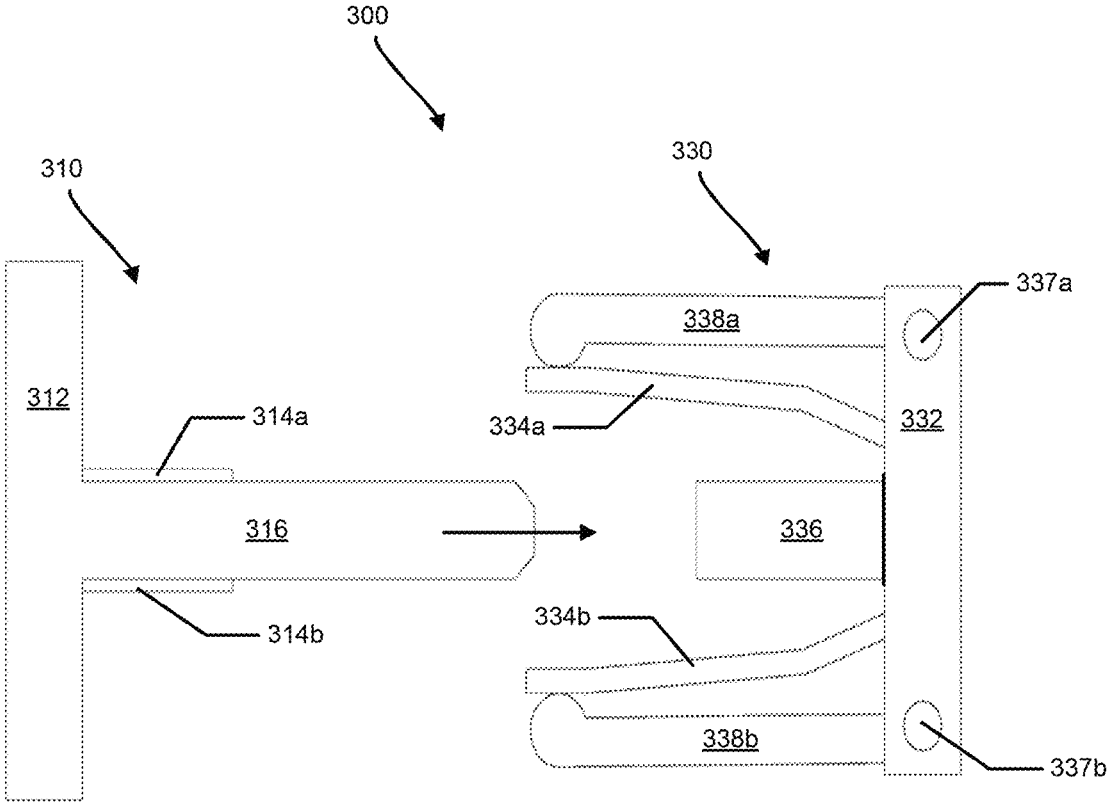
FIGS. 3*a*-3*d* are example embodiments of a connector.

Male conductor component 310 may be inserted into female conductor component 330, thereby forming an electrical connection between the two components. As shown in FIG. 3*a*, engagement member 316 (of male conductor component 310) is aligned with actuator element 336 (of female conductor component 330), and physically moved to contact and engage actuator element 336, as shown by the directional arrow.

Figure 3B:
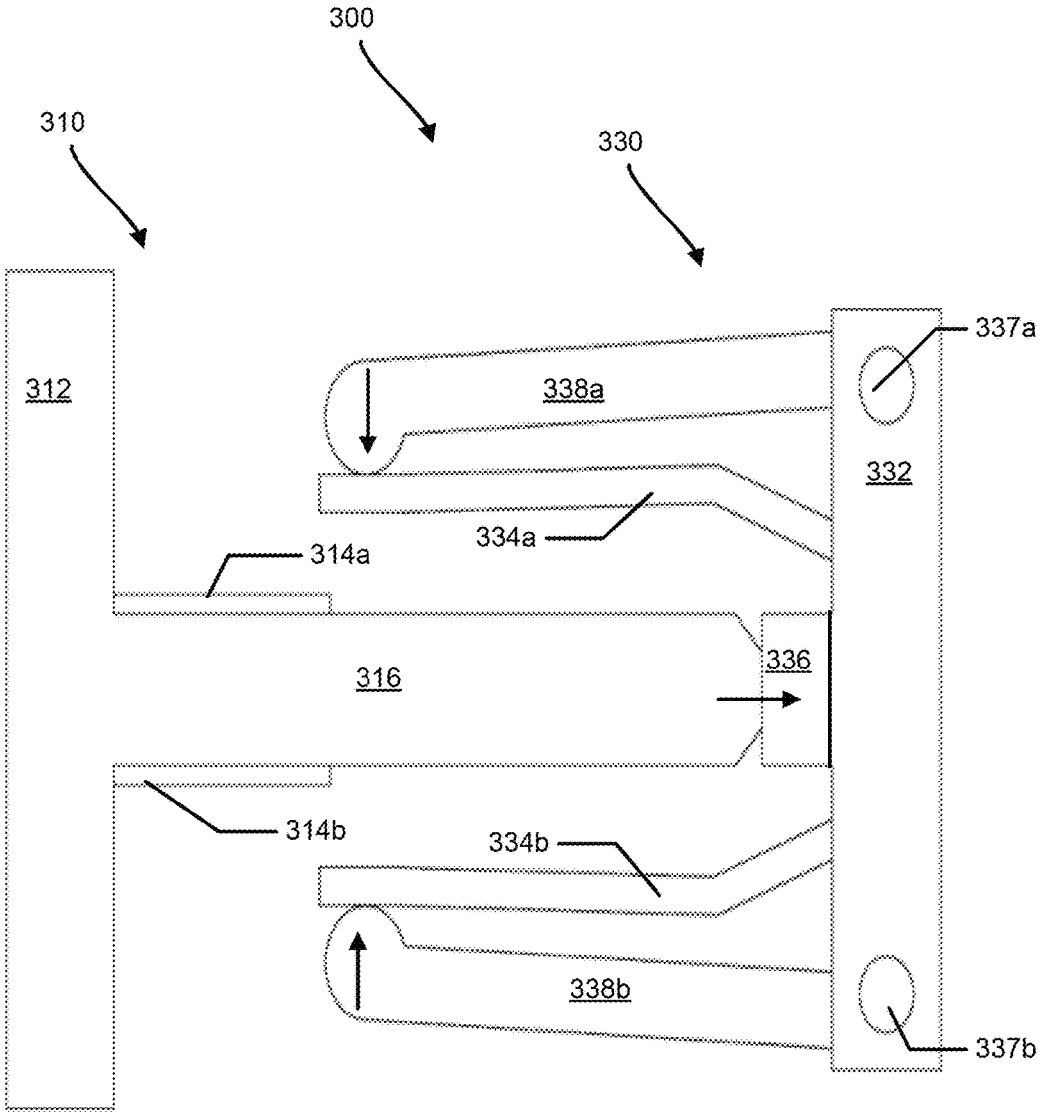

When engagement member 316 is further pushed against actuator element 336, actuator element 336 is depressed into the body of electrical connector element 332. This is shown in FIG. 3*b* by the directional arrow indicating movement of both engagement member 316 and actuator element 336 relative to electrical connector element 332. As actuator element 336 is depressed into the body of electrical connector element 332, actuator element 336 actuates actuator arms 338*a* and 338*b*, via the above-discussed linkage mechanism. In turn, actuator arms 338*a* and 338*b* bear against conduction arms 334*a* and 334*b*, respectively, forcing conduction arms 334*a* and 334*b* towards each other and towards engagement member 316 in a pincing movement, as shown by the directional arrows indicating relative movement of actuator arms 338*a* and 338*b*.

Figure 3C:
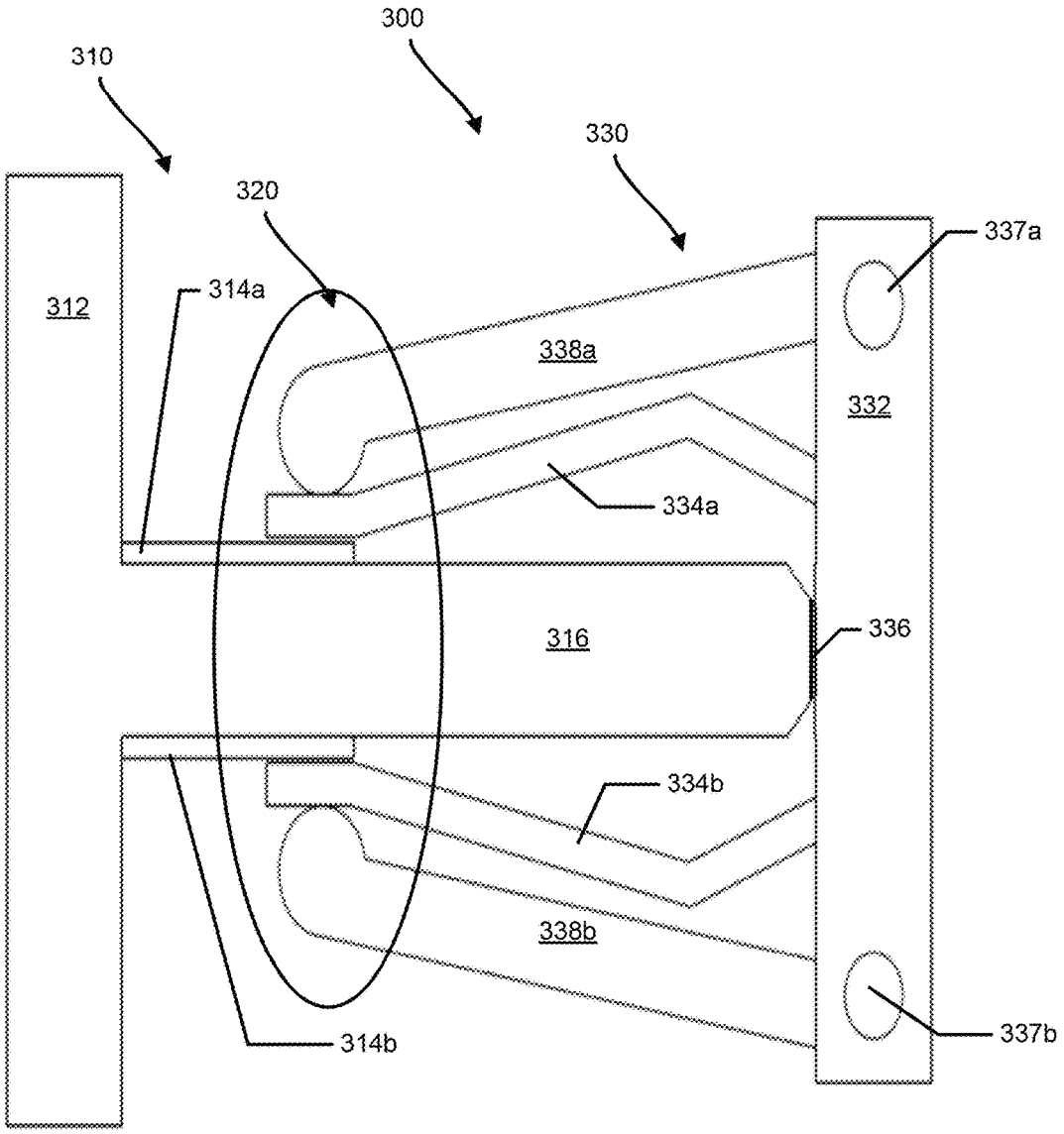

When male conductor component 310 is fully inserted into female conductor component 330, as shown in FIG. 3*c*, engagement member 316 fully engages actuator element 336 such that actuator element 336 is fully depressed into the body of electrical connector element 332. Full engagement of actuator element 336 such that 336 is fully depressed into the body of electrical connector element 332 in turn results in full actuation of actuator arms 338*a* and 338*b* via the linkage mechanism such that actuator arms 338*a* and 338*b* bear against conduction arms 334*a* and 334*b*, causing conduction arms 334*a* and 334*b* to contact conduction elements 314*a* and 314*b*, respectively. As can be seen from FIG. 3*c*, conduction elements 314*a* and 314*b* are in a position to contact conduction arms 334*a* and 334*b* due to the displacement of engagement member 316 relative to female conductor component 330.

Full actuation of actuator element 336 by engagement member 316 causes actuator arms 338*a* and 338*b* to clamp conduction arms 334*a* and 334*b* against and into contact with conduction elements 314*a* and 314*b*. As a result, electrical connector element 312 is electrically coupled to electrical connector element 332 such that electrical signals may propagate between electrical connector element 312 and electrical connector element 332 via conduction elements 314*a* and 314*b* and actuator arms 338*a* and 338*b*. Thus, male conductor component 310 and female conductor component 330 are electrically connected. 320 illustrates the connection junction.

Figure 3D:
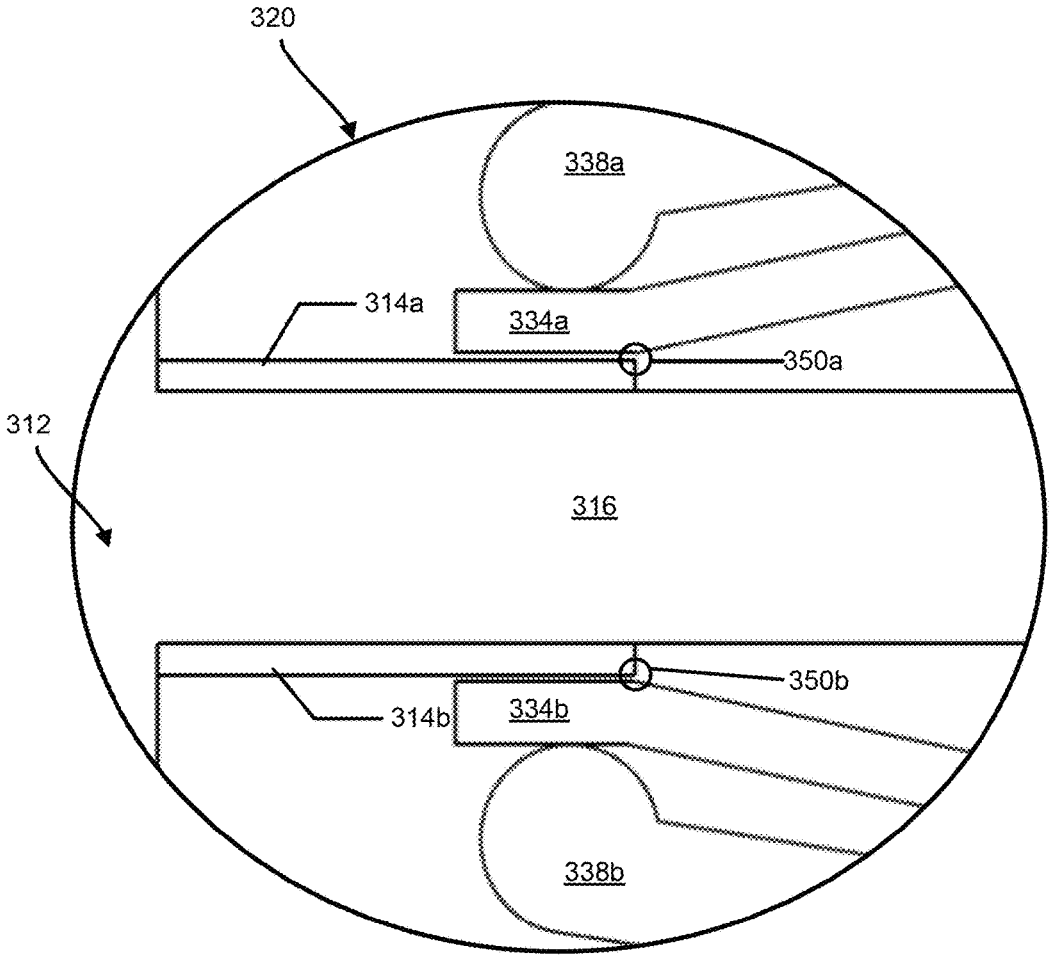

FIG. 3*d* shows connection junction 320 in more detail. As can be seen, the rounded distal ends of actuator arms 338*a* and 338*b* impel the flattened distal ends of conductions arms 334*a* and 334*b*, respectively, against conduction elements 314*a* and 314*b*, respectively, positioned on engagement member 316, thereby forming an electrical connection between electrical connector element 332 (not shown) and electrical connector element 312. As can be seen from enlarged connection junction 320, stubs are minimized. That is, any extensions 350*a* and 350*b* of 314*a* and 314*b*, respectively, beyond the connections with conduction arms 334*a* and 334*b*, respectively, are minimized, an are amendable to diminished length by increasing the tolerances of manufacture of connector 300. Thus, the attenuation frequency of connector 300 is pushed out (that is, increased) relative to connectors 100 and 200.

The amount of engagement force between actuator arms 338*a* and 338*b*, conduction arms 334*a* and 334*b*, respectively, and conduction elements 314*a* and 314*b*, respectively, can be effectuated by the timing of the mechanical linkage of female conductor component 330. Similarly, a wiping action between conduction arms 334*a* and 334*b*, and conduction elements 314*a* and 314*b*, respectively, can be effectuated by the timing of the mechanical linkage of female conductor component 330.

Figure 4:
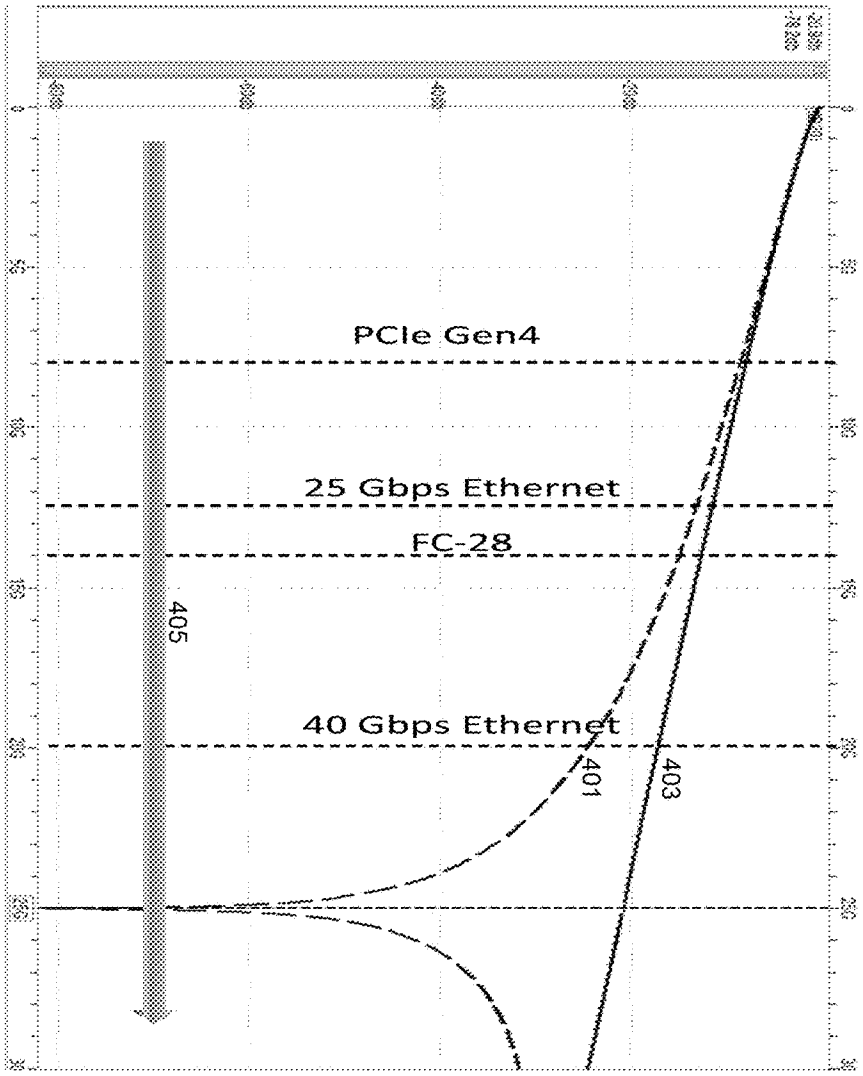
FIG. 4 is a graph of a connector attenuation associated with embodiments of connectors.

FIG. 4 shows a graph 400 that illustrates the attenuation difference between a prior art connector such as connector 100 or 200 and a connector such as connector 300. Trace 401 indicates the attenuation of a prior art connector such as connector 100 or 200 discussed above. As can be seen from trace 401, there is a severe signal attenuation at 25 G. Trace 403 indicates the attenuation characteristics of a connector such as connector 300, discussed above. As can be seen from trace 403, a connector such as connector 300 does not suffer from the prior art level of severe attenuation at 25 GHz, and furthermore, the attenuation frequency of a connector such as connector 300 has been pushed out well beyond the prior art attenuation frequency of 25 GHz (as indicated by arrow 405). Thus, connector 300 can more effectively propagate a higher range of frequencies relative to prior art connectors and may therefore provide a better electrical connection at higher frequencies.

In the embodiments described herein, an information handling system includes any instrumentality or aggregate of instrumentalities operable to compute, classify, process, transmit, receive, retrieve, originate, switch, store, display, manifest, detect, record, reproduce, handle, or use any form of information, intelligence, or data for business, scientific, control, entertainment, or other purposes. For example, an information handling system can be a personal computer, a consumer electronic device, a network server or storage device, a switch router, wireless router, or other network communication device, a network connected device (cellular telephone, tablet device, etc.), or any other suitable device, and can vary in size, shape, performance, price, and functionality.

The information handling system can include memory (volatile (such as random-access memory, etc.), nonvolatile (read-only memory, flash memory etc.) or any combination thereof), one or more processing resources, such as a central processing unit (CPU), a graphics processing unit (GPU), hardware or software control logic, or any combination thereof. Additional components of the information handling system can include one or more storage devices, one or more communications ports for communicating with external devices, as well as, various input and output (I/O) devices, such as a keyboard, a mouse, a video/graphic display, or any combination thereof. The information handling system can also include one or more buses operable to transmit communications between the various hardware components. Portions of an information handling system may themselves be considered information handling systems.

For example, a portion of an information handling system device may be hardware such as, for example, an integrated circuit (such as an Application Specific Integrated Circuit (ASIC), a Field Programmable Gate Array (FPGA), a structured ASIC, or a device embedded on a larger chip), a card (such as a Peripheral Component Interface (PCI) card, a PCI-express card, a Personal Computer Memory Card International Association (PCMCIA) card, or other such expansion card), or a system (such as a motherboard, a system-on-a-chip (SoC), or a stand-alone device).

Although only a few exemplary embodiments have been described in detail herein, those skilled in the art will readily appreciate that many modifications are possible in the exemplary embodiments without materially departing from the novel teachings and advantages of the embodiments of the present disclosure. Accordingly, all such modifications are intended to be included within the scope of the embodiments of the present disclosure as defined in the following claims. In the claims, means-plus-function clauses are intended to cover the structures described herein as performing the recited function and not only structural equivalents, but also equivalent structures.

What is claimed is:

1. A connector apparatus comprising:

a male conductor component including a member and a pair of conduction elements disposed on the member in opposition to each other, the pair of conduction elements including a first conduction element and a second conduction element, the first and second conduction elements electrically conductive and providing an electrical connection to the male conductor component, the first conduction element providing a first conduction element planar connection plane and the second conduction element providing a second conduction element planar connection plane; and a female conductor component configured to receive the member and including:

a pair of conducting arms, each of the conducting arms electrically conductive and providing an electrical connection to the female conductor component, wherein the conducting arms are opposed to each other and terminate in a flattened distal end with planar connection plane, the pair of conducting arms including a first conducting arm having a first planar connection plane and a second conducting arm having a second planar connection plane; and an actuator mechanism including a pair of actuator arms connected to an electrical connector element with pivots, the actuator mechanism operable to be actuated by the member and configured to force the conducting arms towards each other such that the first planar connection plane contacts the first conduction element planar connection plane in a continuous plane when the actuator mechanism is fully actuated by the member, the continuous plane of contact extending a length of overlap between the first conduction element and the first planar connection plane.

2. The connector apparatus of claim 1, wherein the actuator mechanism comprises an actuator element, wherein the pair of actuator arms are positioned in opposition to each other, wherein the member contacts the actuator element and actuates the actuator element when the female conductor component receives the member.

3. The connector apparatus of claim 2, wherein the actuator element is mechanically coupled to the pair of actuator arms such that actuation of the actuator element causes a portion of each of the pair of actuator arms to move towards each other.

4. The connector apparatus of claim 3, wherein the actuator element is mechanically coupled to the pair of actuator arms interior to a mechanical body of the female electrical connector element.

5. The connector apparatus of claim 4, wherein the actuator element is configured to be depressed in the body of the female electrical connector element to actuate the pair of actuator arms.

6. The connector apparatus of claim 3, wherein the pair of actuator arms are positioned to bear against the pair of conducting arms to cause the conducting arms to clamp the member in a pincing motion such that one of the conducting arms contacts the first conduction element.

7. The connector apparatus of claim 1, wherein actuator mechanism is configured to force the conducting arms towards each other such that the second planar connection plane contacts the second conduction element planar connection plane in the continuous plane when the actuator mechanism is fully actuated by the member.

8. The connector apparatus of claim 7, wherein the male conductor component comprises a male electrical conductor element and a base of the member is coupled to the male electrical conductor element, wherein the first and second conduction elements are disposed on the member towards the base of the member.

9. The connector apparatus of claim 8, wherein the conducting arms clamp against the first and second conduction elements to create an electrical connection between the male conductor component and the female conductor component from contact between the first and second conduction elements and the conducting arms.

10. A connector device comprising:

a female conductor component configured to receive a member of a male conductor component and including:

a pair of conducting arms, each of the conducting arms electrically conductive and providing an electrical connection to the female conductor component, wherein the conducting arms are opposed to each other and terminate in flattened distal ends, each flattened distal end providing a planar connection surface; and an actuator mechanism, the actuator mechanism operable to be actuated by the member and configured to force the conducting arms towards each other with a pair of actuator arms connected to an electrical connector element with pivots such that a planar connection surface of the conducting arms contacts a planar conduction plane of a first conduction element of the member to provide a continuous plane of contact between the planar connection surface and the planar conduction plane when the actuator mechanism is fully actuated by the member.

11. The connector device of claim 10, wherein the actuator mechanism comprises an actuator element and the pair of actuator arms are positioned in opposition to each other, wherein the member contacts the actuator element and actuates the actuator element when the female conductor component receives the member.

12. The connector device of claim 11, wherein the actuator element is mechanically coupled to the pair of actuator arms such that actuation of the actuator element causes a portion of each of the pair of actuator arms to move towards each other.

13. The connector device of claim 12, wherein the actuator element is mechanically coupled to the pair of actuator arms interior to a mechanical body of the female electrical connector element.

14. The connector device of claim 13, wherein the actuator element is configured to be depressed in the body of the female electrical connector element to actuate the pair of actuator arms.

15. The connector device of claim 12, wherein the pair of actuator arms are positioned to an outside of the conduction arms and are configured to bear against the pair of conducting arms when actuated to cause the conducting arms to clamp the member in a pincing motion such that one of the conducting arms contacts the first conduction element.

16. The connector device of claim 10, further comprising the male conductor component, wherein the male conductor component comprises a male electrical conductor element and the member is attached to the male electrical conductor element.

17. An information handling system comprising:

a printed circuit board (PCB) with an electrical component; and a female conductor component electrically coupled to the component via the PCB, the female conductor component configured to receive a member of a male conductor component and including:

a pair of conducting arms, each of the conducting arms electrically conductive and providing an electrical connection to the female conductor component, wherein the conducting arms are opposed to each other and terminate in flattened distal ends, each flattened distal end providing a respective planar connection surface; and an actuator mechanism including a pair of actuator arms connected to an electrical connector element with pivots, the actuator mechanism actuated by the member and configured to force the conducting arms towards each other through a pincing of the pair of actuator arms such that a planar connection surface of one arm of the conducting arms contacts a planar conduction plane of a first conduction element of the member to provide a continuous plane of contact between the planar connection surface and the planar conduction plane when the actuator mechanism is fully actuated by the member.

* * * * *